United States Patent [19]

Hein, Jr.

[11] 4,046,317

[45] Sept. 6, 1977

[54] AIR LEVITATION DEVICE FOR AN AIR DRIVEN CENTRIFUGE

[76] Inventor: George Norton Hein, Jr., 331 Chesham Ave., San Carlos, Calif. 94070

[21] Appl. No.: 681,313

[22] Filed: Apr. 29, 1976

[51] Int. Cl.[2] ..... B04B 9/14

[52] U.S. Cl. ..... 233/23 R; 233/23 A; 233/1 C

[58] Field of Search ..... 233/1 R, 23 R, 23 A, 233/24, 1 C; 74/5.43, 5.46; 188/164; 415/123; 310/105

[56] References Cited

U.S. PATENT DOCUMENTS

| | | | |
|---|---|---|---|
| 2,106,609 | 1/1938 | Krauss | 233/24 |
| 2,213,107 | 8/1940 | McBain | 233/23 R |
| 2,872,104 | 2/1959 | Cizinsky | 233/23 R |
| 3,456,875 | 7/1969 | Hein | 233/24 |
| 3,958,753 | 5/1976 | Durland et al. | 233/23 R |

*Primary Examiner*—George H. Krizmanich
*Attorney, Agent, or Firm*—Robert J. Steinmeyer; Ferd L. Mehlhoff; William H. May

[57] ABSTRACT

An air levitation jet located in the center of a rotor seat to provide a supporting and holding air flow between a rotor and the rotor seat. Integrally formed within both the rotor and the rotor seat are conical and frustoconical portions which respectively establish a conical flow path and an adjoining frustoconical flow path to aid not only in the centering of the rotor within the rotor seat, but also in the retaining of the rotor in alignment with its rotational axis. Air under pressure exiting the levitation air jet in the center of the rotor seat proceeds along the conical flow path and into the frustoconical flow path with sufficient velocity to establish a reduced pressure in the flow path between the rotor and rotor seat that is less than atmospheric pressure, causing the rotor to remain securely positioned on a cushion of air within the rotor seat.

11 Claims, 4 Drawing Figures

FIG. 3
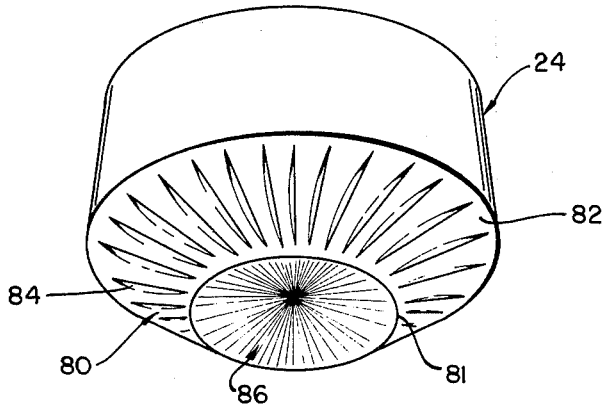
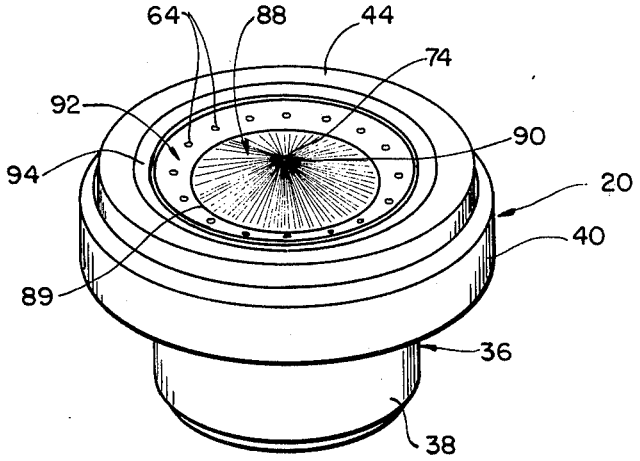
FIG. 4

AIR LEVITATION DEVICE FOR AN AIR DRIVEN CENTRIFUGE

BACKGROUND OF THE INVENTION

The invention described herein relates generally to an air driven centrifuge and more particularly to an improved apparatus for holding and stabilizing such rotor during its deceleration.

In order to separate certain fluid mixtures, very high speeds of rotation are required. For example, separation of protein, viruses and other various clinical specimens require extremely high speeds of centrifugation in order to separate fractions thereof within reasonable time spans. It has been found that extremely high rotational speeds such as 150,000 r.p.m. to 200,000 r.p.m. can be obtained by rotating a centrifuge rotor on a cushion of air with pressurized air streams. An example of such as air driven centrifuge is illustrated in U.S. Pat. No. 3,456,875 issued to me on July 22, 1969.

In the case of air driven centrifuges, when the driving air has been shut down after the centrifugation of the fluid mixture, a secondary supporting supply of air must be introduced between the rotor and rotor seat to hold the rotor off the rotor seat as the rotor decelerates to a stop. However, in some present devices because of the location of the flutes on the rotor the introduction of a supporting air supply will never allow the rotor to completely stop, since this air movement across the rotor flutes will tend to continue driving the rotor slightly on the supporting air. This supporting air is generally introduced along the outer frustoconical portion of the rotor seat adjacent the location of the driving air jets.

In some instances, the orientation of the driving air jets is reversed to not only supply supporting air, but also to aid in the deceleration of the rotor to a stop. In some cases the use of the reversing air jets may cause the start of a reverse rotation of the rotor after it has stopped. Consequently, many arrangements now used do not provide a friction free cushion of air which allows the rotor to decelerate independent of any driving effects of the supporting air.

A significant problem also exists with respect to the inherent design of every rotor in addition to the characteristics of the test mixtures in the rotor, presenting certain parameters which create critical speeds where the rotor will precess, wobble or vibrate excessively while decelerating. These critical speeds are usually relatively low rotational speeds and the precession and/or wobblng can become so great as to cause the sample to be remixed or to cause the rotor to contact the sidewalls of the seat, causing the rotor to become misaligned from its rotational axis and thrash around within the centrifuge housing.

Consequently, some prior art arrangements incorporate a stabilizing means to physically contact or guide the rotor as it experiences these slow critical speeds to help eliminate the above described undesirable effects. The supporting air in these devices provide sufficient stabilization to overcome the problems encountered during the critical speeds of the rotor, but such stabilizing devices must be quite delicate in design to provide the requisite stabilizing and are subject to constant wear.

In addition, other supporting air arrangements used heretofore tend to establish a cushion of air which causes the rotor to ride somewhat high within the rotor seat. In other words, the rotor is separated from the surface of the rotor seat more than desirable, rendering the rotor more susceptible to various unstabilizing conditions and possible ejection from the rotor seat.

SUMMARY OF THE INVENTION

The present invention comprises a specifically designed rotor and rotor seat which act in conjuction with each other to form a flow path for receipt of a flow of air at sufficient velocity from the center of the rotor seat to reduce the air pressure in the flow path between the rotor and the rotor seat to below atmospheric pressure, establishing a holding effect on the rotor within the rotor seat. The center of the rotor seat has a unique conical design while the rotor has a mating conical recessed portion in its lower surface. This conical configuration of the rotor and rotor seat aids in the maintenance of the proper alignment of the rotor with its rotational axis as well as the centering of the rotor within the rotor seat.

A levitation air jet which is located in the center of the rotor seat provides a flow of air which is not biased to turn the rotor in either direction and, therefore, allows the rotor to freely float on a virtually friction free cushion of levitation air to permit either the quick braking of the rotor or the coasting of the rotor to a gradual stop.

The configuration of the rotor and rotor seat in conjunction with the location of the levitation air jet utilize Bernouilli's principle that air pressure between the rotor and rotor seat can be reduced to less than atmospheric pressure because of air flowing at sufficient velocity from the levitation air jet and through both the conical flow path at the central area of the rotor seat and rotor and a frustoconical flow path, which is between the outer portion of both the rotor and the rotor seat. Because of the reduced air pressure between the rotor and rotor seat, the rotor is held closer to the rotor seat than in prior arrangments, providing less susceptibility of the rotor being misaligned from its rotational axis or being pulled out of the rotor seat.

Therefore, the present invention not only establishes a friction free air bearing which reduces the bias of the rotation of the rotor during deceleration, but also securely retains the rotor stably within the rotor seat.

BRIEF DESCRIPTION OF THE DRAWINGS

FIG. 3 is a perspective view of the rotor showing the lower end of the conical recess in the rotor; and FIG. 4 is a perspective view of the rotor seat showing the central conical projection and the outer frustoconical portion.

DETAILED DESCRIPTION OF THE INVENTION

Figure 1:
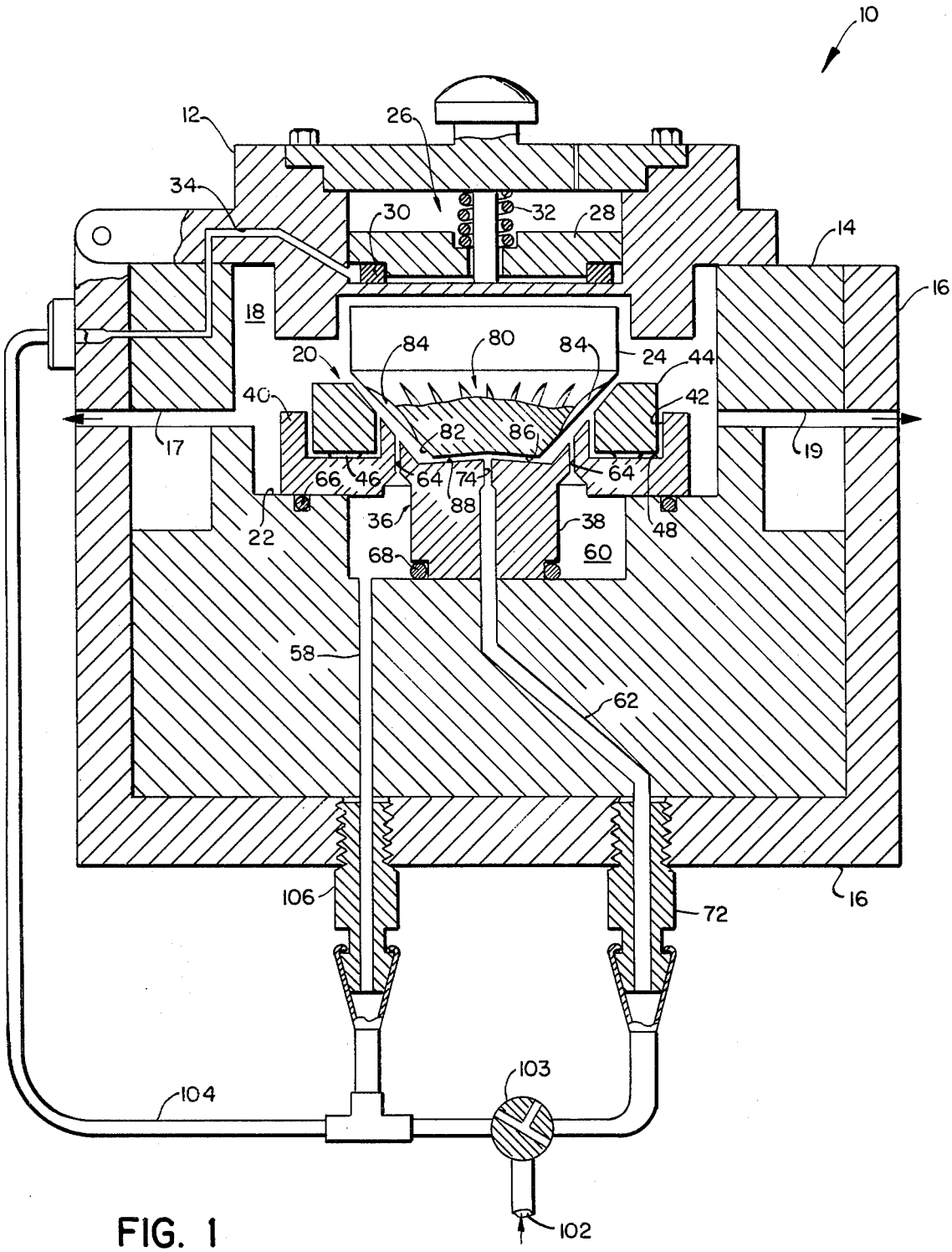
FIG. 1 is a sectional elevation view of the air levitation apparatus in the present invention.

An air driven centrifuge apparatus 10 is shown in FIG. 1. A removable cover 12 is situated over a rotor housing 14. The overall housing 14 is enclosed by an outer casing 16. The housing 14 in conjunction with the cover 12 forms a rotor chamber 18 in which is situated a rotor seat 20 adjacent the bottom 22 of the chamber 18 for receipt of a rotor 24.

It should be noted that the cover 12 contains a braking apparatus 26 in the present embodiment wherein a nonmagnetic carrier 28 shifts a magnet or series of magnets 30 toward and away from the rotor 24 for quickly decelerating the rotation of the rotor 24 in the housing 14. The spring 32 forces the carrier 28 toward the rotor 24 for quick braking of the rotor while the introduction of air pressure through air passage 34 will move the carrier 28 away from the rotor, allowing free rotation of the rotor. The operation and structure of the braking apparatus 26 is shown in more detail in a copending application filed by Douglas H. Durland, George N. Hein, Jr. and Robert J. Ehret on even date herewith entitled An Eddy Current Brake for an Air Driven Centrifuge.

Figure 2:
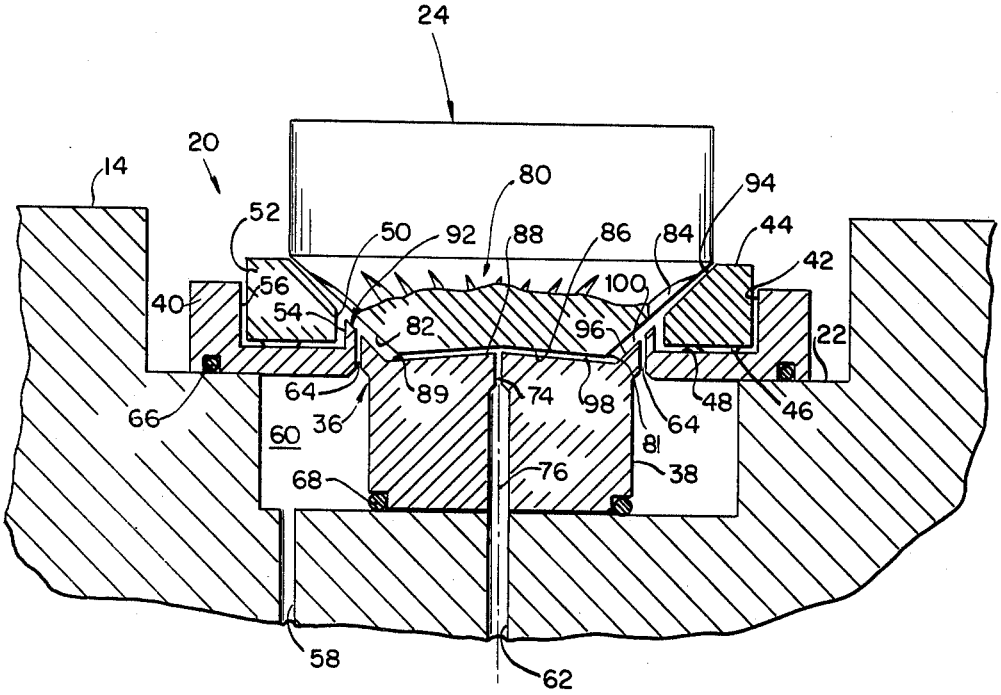
FIG. 2 is a detailed sectional elevation view of the rotor and rotor seat area.

The rotor seat 20, shown in more detail in FIG. 2, is comprised of a generally cylindrical stator body 36 having a depending central portion 38 and an annular flange portion 40. Located within the annular flange portion 40 of the stator body 36 is a stator cavity 42 which contains the stator pad 44. The bottom of the stator pad 44 has a plurality of extended portions or feet 46 which rest on the bottom 48 of the stator cavity 42. The diameter of the inner surface 50 and the diameter of the outer surface 52 of the stator pad are respectively greater and smaller than the diameter of the inner surface 54 and the outer surface 56 of the stator cavity 42. Therefore, the stator pad 44 is permitted to move in a precessional manner to accommodate slight movement of the rotor 24 in a direction lateral to its rotational axis. The stator pad 44 provides stability to the rotation of the rotor 24 within the rotor seat 20.

Located adjacent the depending central portion 38 of the stator body 36 is an annular manifold 60 which is in fluid communication with a driving air passage 58. The stator body 36 contains a series of driving air jets 64 which are in fluid communication with the annular manifold 60. The annular flange portion 40 of the body is sealed against the housing 14 by a sealing O-ring 66 while the depending central portion 38 of the stator body is sealed against the housing by a second sealing O-ring 68.

Extending through the center of the depending central portion 38 of the stator body is an air levitation flow conduit 62 which is aligned and in fluid communication with a supporting or holding air jet 74 centrally located in the rotor seat 20.

The rotor 24, which is, in a preferred embodiment, approximately 1½ inches in diameter, is situated within the rotor chamber 18 with its lower portion 80 positioned within the rotor seat 20. As shown more clearly in FIG. 3, the lower portion 80 of the rotor 24 has a frustoconical area 82 which is sloped inward and has on its surface a series of flutes 84 that receive the pressurized air from the air jets 64 of FIG. 2 to rotate the rotor 24 at high rotational speeds to subject the sample mixtures within the rotor to the centrifugation forces for segregating out various constituents. With respect to FIG. 3, the central area 86 within the lower portion 80 of the rotor has a recessed conical shape extending inward from the smallest circumferential edge 81 of the frustoconical area 82. As shown in FIG. 4, the central area 88 of the rotor seat 20 has a slight conical shape projecting outward which has a base circumferential edge 89. Located at the apex 90 of the central area 88 in the rotor seat is the air levitation jet 74. The outer area 92 of the rotor seat is in the shape of an inverted frustocone. Part of the outer area 92 of the rotor seat 20 is comprised of the sloping surface 94 on the stator pad 44. Therefore, the supporting area of the rotor seat 20 which receives the lower portion 80 of the rotor is comprised of the central cone area 88, the portion 96 of the inverted frustoconical surface on the stator body 36, and the sloping surface 94 of the stator pad 44.

As shown in FIG. 2, the central area 86 in the lower portion 80 of the rotor mates or nests somewhat with the central area 88 of the rotor seat while the frustoconical portion 82 of the lower portion 80 of the rotor mates or nests with the frustoconical portions 94 and 96 of the rotor seat 20. The respective recessed central conical area 86 in the rotor in conjunction with the projecting conical central area 88 of the rotor seat forms a conical flow path 98 for the air exiting the air jet 74. Further, the frustoconical shape of the outer area 82 of the rotor lower portion 80 in conjunction with the frustoconical shape of the outer portions 94 and 96 of the rotor seat provides a frustoconical flow path 100 in fluid communication with the conical flow path 98 through which the air proceeds from the air jet 74 out into the rotor chamber 18.

Turning to the operation of the present invention, attention is directed to FIG. 1 where the rotor 24, containing a fluid mixture for centrifugation to separate out various constituents in the fluid mixture, is placed within the rotor chamber 18. The lower portion 80 of the rotor is positioned within the supporting area of the rotor seat 20. It should be noted, however, that the sloping surface 94 of the stator pad 44 has a slightly steeper slope than that of the frustoconical portion 96 in the stator body 36. Therefore, the rotor 24, when at rest and nesting within the rotor seat 20, bears primarily on the stator pad 44, but also may contact or come closely adjacent to the conical central area 88 of the rotor seat.

An air supply conduit 102 provides air under pressure by control of the valve 103 through supply line 104 and through coupling 106 to supply line 58. The air proceeding through line 104 flows into passage 34 in the cover 12 to force the braking apparatus away from the rotor to allow free rotation of the rotor as explained in more detail in the previously referenced application for an Eddy Current Brake. The air proceeding through line 58 enters the annular manifold 60 where it proceeds through a plurality of air jets 64 that impinge air under pressure on the rotor flutes 84, causing the rotor 24 to rotate at very high speeds. The air that is introduced from the air driving jets 64 and onto the flutes 84 process out between the rotor and the stator pad 44 into the rotor chamber 18 where it exits the centrifuge through the exit ports 17 and 19. Further, the driving air also holds the rotor 24 on a cushion of air above the rotor seat 20 for support upon which the high speed rotation occurs.

It should be noted that alternate driving means, such as an electromagnetic driving mechanism, could be utilized to drive the rotor in conjunction with the air levitation arrangement of the present invention.

When the centrifugation operation has been completed, the valve 103 is moved to stop the flow of air through the supply lines 104 and 58. At the same time the valve 103 permits a supply of pressurized air from the air supply conduit 102 to flow through a coupling 72 and into an air levitation supply line 62 for flow into the air levitation jet 74. The capacity of the air conduit 62 from the air supply conduit 102 to the air levitation jet 74 should preferably be sufficiently larger than the capacity of the air conduit 58 from the air supply conduit 102 to the air driving jets 64, so that there is a slight dwell between the cessation of the air flow exiting the air driving jets 64 and the commencement of the air flow exiting the air levitation jet 74. It is preferable that the air flow is not exiting both the air levitation jet 74 and the air driving jets 64 at the same time, because some instability may be introduced to the rotor 24. Consequently, the longer or greater capacity of the air passage 62 between the air supply conduit 102 and the air levitation jet 74 provides the desirable delay in the air flow exiting the levitation jet 74 until the air flow exiting the air drive jets 64 has ceased. Although the preferable mode of operation is to not have the driving air and the levitation air contacting the rotor at the same time, an arrangement of having both the driving and levitation air contacting the rotor simultaneously at various stages of the operation would be permissible without adversely affecting the stability of the rotor.

The air under pressure exiting the levitation jet 74 proceeds along the conical flow path 98 and into the frustoconical flow path 100 from which it exits into the rotor chamber 18. Since the air is flowing in a smooth path generally parallel with the frustoconical flow path 100, essentially no forcing air impinges upon the rotor flutes 84, allowing the rotor 24 to coast freely during deceleration and braking by the braking apparatus 26.

Because the air flowing from the air levitation jet 74 and through the conical flow path 98 and the frustoconical flow path 100 is proceeding at a significant velocity, the air pressure in the space between the rotor 24 and the rotor seat 20 is reduced to below atmospheric pressure due to the Bernouilli's principle that, as air increases speed, air pressure will decrease. Therefore, the atmospheric pressure surrounding the majority of the rotor 24 will hold the rotor stable and secure in the rotor seat 20. Consequently, the rotor 24 will ride down within the rotor seat where the separation of the rotor and rotor seat may be as little as approximately five thousandths of an inch. The ability to hold the rotor closely within the rotor seat is particularly important during the deceleration phases of the rotor when it reaches critical speeds that might tend to induce vibration and wobbling.

In addition, the slight conical central portion 88 of the rotor seat 20 and the slight conical central recessed area 86 in the rotor provide an air in conjunction with the stator pad 44 in maintaining the rotational stability of the rotor, keeping its rotational axis aligned with the central axis of the rotor seat. Although the slight conical surfaces in the central portion 88 of the rotor seat and the central area 86 of the rotor have been constructed with approximately a 5° optimum slope, it is envisioned that the slope can be in the preferred range of 3° to 10° and still permit the proper air levitation of the rotor for a stable deceleration of the rotor. Furthermore, a slope as high as 45° has been successfully used, but the lateral clearance between the respective surfaces 86 and 88 in FIG. 2 becomes quite small as compared to the lateral clearance between the surfaces 86 and 88 with a lesser degree slope. Consequently, the steepness of the slope reduces the lateral movement tolerance of the central area 86 of the rotor 24 on central portion 88 of the rotor seat 20. The spacing between the central area 86 of the rotor and the central portion 88 of the rotor seat to accommodate lateral movement of the rotor decreases as the steepness of the conical slope increases. As this spacing decreases in size it becomes a significant factor during critical speeds of the rotor when it may tend to wobble and incur some lateral movement, resulting in an undesired contact between the central area 86 of the rotor with the central portion 88 of the rotor seat while the rotor is still spinning.

The rotor 24 and stator pad 44 can move laterally if necessary for compensation of critical speeds, but they will not move to an extend where the conical surfaces could contact or separate to such an extent that the generation of the Bernouilli forces would be hampered.

It should be noted that the projecting conical area 88 of the rotor seat could be in the configuration of a partial spherical surface rather than a cone while the recessed central portion 86 of the lower end 80 of the rotor could be in the configuration of a mating partial spherical surface. Further, the recessed portion 86 in the rotor could be constructed as the projecting portion while the projecting portion 88 in the rotor seat could be constructed as a mating recessed portion. In other words, the projecting portion of a conical or spherical shape could be located on either the rotor or the rotor seat while the recessed portion of a mating conical or spherical shape could be located on either the respective rotor or rotor seat.

It is envisioned that the embodiments of the present invention set forth herein could be structurally modified, but remain within the scope of the invention.

What is claimed is:

1. An air driven centrifuge comprising:

a rotor;

a rotor seat for receipt of the lower portion of said rotor;

driving air jet means for rotating said rotor on a cushion of air;

a central recessed portion in the bottom of said rotor;

a projecting central portion in the bottom of said rotor seat, said central recessed portion and said projecting central portion having similar shapes and dimensions, so that said central recessed portion of said bottom of said rotor and said projecting central portion of said bottom of said rotor seat cooperatively establish a specific confined flow path between said rotor and said rotor seat along said central recessed portion of said rotor; and means located in said projecting central portion of said rotor seat acting in conjunction with said flow path for introducing a supply of supporting air into said flow path with sufficient velocity, so that the air pressure within said flow path is below atmospheric pressure to hold said rotor within said rotor seat and allow said rotor to decelerate to a stable stop when said driving air jet means is not rotating said rotor.

2. An air driven centrifuge as defined in claim 1 and additionally comprising:

an air supply source;

a first air passage for connecting said air supply source in fluid communication with said driving air jet means; and a second air passage within said housing for connecting said air supply source in fluid communication with said supporting air means, said second air passage having an air capacity greater than the air capacity of said first air passage.

3. A centrifuge comprising:

a rotor;

a rotor seat for receipt of said rotor;

driving means for rotating said rotor on a cushion of air;

means recessed within the bottom of said rotor and projecting from the bottom of said rotor seat for establishing a confined flow path between said rotor and said rotor seat; and means acting cooperatively with said flow path for introducing a continuous supply of supporing air along substantially all of said flow path with sufficient velocity so that the air pressure within said flow path is below atmospheric pressure to hold said rotor within said rotor seat.

4. An air driven centrifuge comprising:

a rotor;

a rotor seat for receipt of the lower portion of said rotor;

means in driving communication with said rotor for rotating said rotor;

air jet means located in the center of said rotor seat; and means within the central area of the bottom of said rotor and in the central area said rotor seat acting cooperatively with said air jet means for centering and supporting said rotor within said rotor seat on a cushion of air as said rotor decelerates.

5. An air driven centrifuge as defined in claim 4 wherein said centering and supporting means comprises:

a conical portion in the central area of said rotor seat; and a conical portion in the central area of said lower portion of said rotor, one of said conical portion in said rotor seat and said conical portion in said rotor projecting toward the other of said conical portion in said rotor seat and said conical portion in said rotor, said other of said conical portion in said rotor seat and said conical portion in said rotor being recessed.

6. An air driven centrifuge as defined in claim 4 wherein said centering and supporting means comprises:

a partial spherical portion in the central area of said rotor seat; and a partial spherical portion in the central area of said lower portion of said rotor, one of said spherical portion in said rotor seat and said spherical portion in said rotor projecting toward the other of said spherical portion in said rotor seat and said spherical portion in said rotor, said other of said spherical portion in said rotor seat and said spherical portion in said rotor being recessed.

7. A centrifuge comprising:

a rotor;

a rotor seat for receipt of the lower portion of said rotor;

a conical portion in the central area of said rotor seat projecting toward said rotor;

a frustoconical portion in said rotor seat projecting outward from the outer circumferential edge of said conical portion and toward said rotor;

a frustoconical lower portion of said rotor; and a conically shaped recessed portion of said rotor extending inward from the smallest circumferential edge of said frustoconical lower portion of said rotor.

8. An air driven centrifuge comprising:

a rotor having a recessed bottom portion;

means for rotating said rotor;

a rotor seat for receipt of said rotor, said rotor seat having a projecting central area; and air jet means within the center of said rotor seat for holding said rotor in a suspended orientation adjacent and above said rotor seat, the configuration of the surface of said recessed bottom portion of said rotor having substantially the same configuration as the receiving surface of said projecting central area of said rotor seat to allow nesting of said rotor within said rotor seat so that all of said surface of said recessed bottom portion of said rotor is closely adjacent and approximately an equal distance from said projecting central area of said rotor seat when said air jet means is projecting a flow of air from said center of said rotor seat along a flow path established between said surface of said recessed bottom portion of said rotor and said projecting central area of said rotor seat, said flow of air in said path reducing the air pressure within said path to less than atmospheric pressure to hold said rotor within said rotor seat on a cushion of air.

9. An air driven centrifuge comprising:

a rotor;

a rotor seat for receipt of the lower portion of said rotor; and air jet means located in the central axis of said rotor seat, the inner portion of said seat forming in conjunction with a recessed central area in the lower portion of said rotor a conical air flow path in a generally downward direction, the outer portion of said seat forming in conjunction with a sloping outer area in the lower portion of said rotor a frustoconical air flow path in a generally upward direction, said conical flow path being in fluid communication with said frustoconical flow path, allowing air from said air jet means to flow sequentially through said conical flow path and into said frustoconical flow path to hold said rotor securely centered over said seat on a cushion of air.

10. An air driven centrifuge comprising:

a rotor housing;

a rotor positioned within said housing;

a rotor seat located adjacent the bottom of said housing for receipt of said rotor;

a first air jet means in said rotor seat for impinging pressurized air streams against said rotor to rotate and support said rotor on an air cushion over said rotor seat;

a second air jet means in substantially the center of said rotor seat for supplying a flow of air along the lower surface of said rotor to support and hold said rotor within said rotor seat and aligned with its rotational axis during deceleration of said rotor;

an air supply source;

a first air supply passage within said centrifuge connecting said air supply source and said first air jet means; and a second air supply passage within said centrifuge connecting said air supply source and said second air jet means, said second air supply passage having a greater capacity than said first air supply passage to establish a slight dwell period between the simultaneous stop of air flow through said first air passage and start of air flow through said second air passage.

11. An air driven centrifuge comprising:

a rotor housing;

a rotor positioned within said housing;

a rotor seat located adjacent the bottom of said housing for receipt of the lower portion of said rotor;

a conical portion in the central area of said rotor seat projecting toward said rotor;

a frustoconical portion in said rotor seat projecting outward from the base circumferential edge of said conical portion and toward said rotor;

a frustoconical lower portion of said rotor;

a conically shaped recessed portion of said rotor extending inward from the smallest circumferential edges of said frustoconical lower portion of said rotor;

driving air jet means in said frustoconical portion of said rotor seat for rotating said rotor;

supporting air jet means in the center of said conical portion of said rotor seat for supporting and holding said rotor on a cushion of air when said driving air jet means is not operating;

an air supply source;

a first air passage line within said centrifuge connecting said air supply source and said driving air jet means; and a second air passage line within said centrifuge connecting said air supply source and said holding air jet means, said second air passage having a greater air capacity than said first air passage.

* * * * *